US005527247A

United States Patent [19]

Archambault

[11] Patent Number: 5,527,247

[45] Date of Patent: Jun. 18, 1996

[54] EXERCISE APPARATUS

[76] Inventor: Darrell H. Archambault, 7470 N. Crystal Rd., Vestaburg, Mich. 48891

[21] Appl. No.: 306,837

[22] Filed: Sep. 15, 1994

[51] Int. Cl.[6] ..... A63B 23/10

[52] U.S. Cl. ..... 482/79; 482/123; 482/124; 482/129; 601/122; 601/128

[58] Field of Search ..... 482/79, 54, 132, 482/123, 124, 129; 601/122, 128

[56] References Cited

U.S. PATENT DOCUMENTS

| | | | |
|---|---|---|---|
| 1,569,467 | 1/1926 | Edwards . | |
| 2,219,624 | 10/1940 | Dixon | 601/122 |
| 2,438,249 | 3/1948 | Mattison | 601/122 |
| 2,512,904 | 6/1950 | Strelecky . | |
| 2,593,982 | 4/1952 | Cash . | |
| 3,205,888 | 9/1965 | Stroop . | |
| 4,010,743 | 3/1977 | Fitzsimons . | |
| 4,011,862 | 3/1977 | Kosiak | 601/122 |
| 4,154,232 | 5/1979 | Fukazawa | 601/122 |
| 4,167,940 | 9/1979 | Ruf . | |
| 5,094,225 | 3/1992 | Craw . | |

FOREIGN PATENT DOCUMENTS

| | | | |
|---|---|---|---|
| 0658989 | 12/1986 | Switzerland | 601/122 |

*Primary Examiner*—Lynne A. Reichard
*Attorney, Agent, or Firm*—Learman & McCulloch

[57] ABSTRACT

Exercise apparatus comprising a frame on which is journalled at least one bank of rollers presenting an arcuate support for a person's foot. The bank of rollers is of such length as to provide continuous support for the foot as the person's leg is oscillated while the person is in a sitting position.

17 Claims, 3 Drawing Sheets

9
14
3
8
11
14
7
1
5
6
13
13
10
12
A
2
15
13
15

14
3
10
15
1
A
2
13

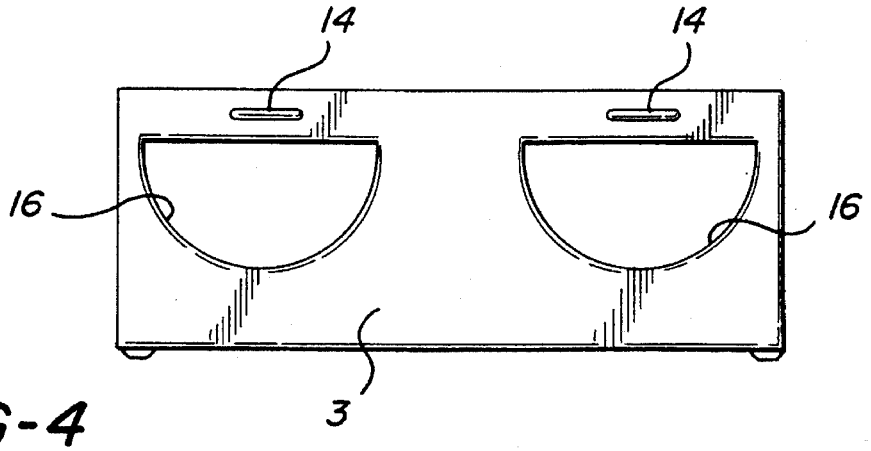
FIG-4
FIG-3
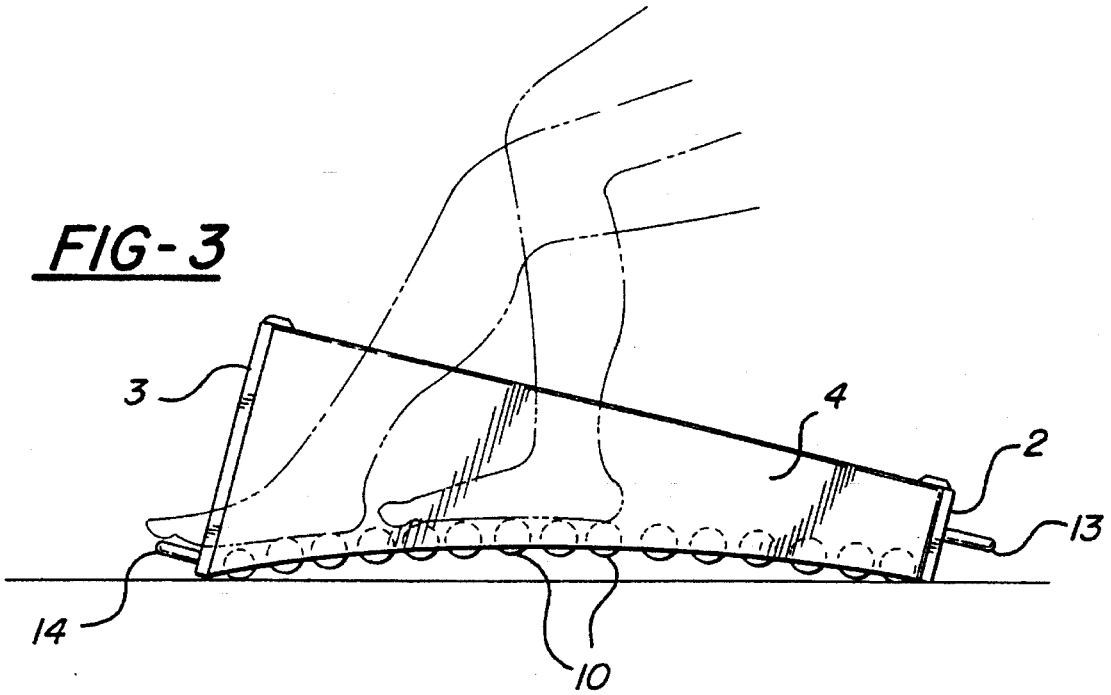
FIG-5
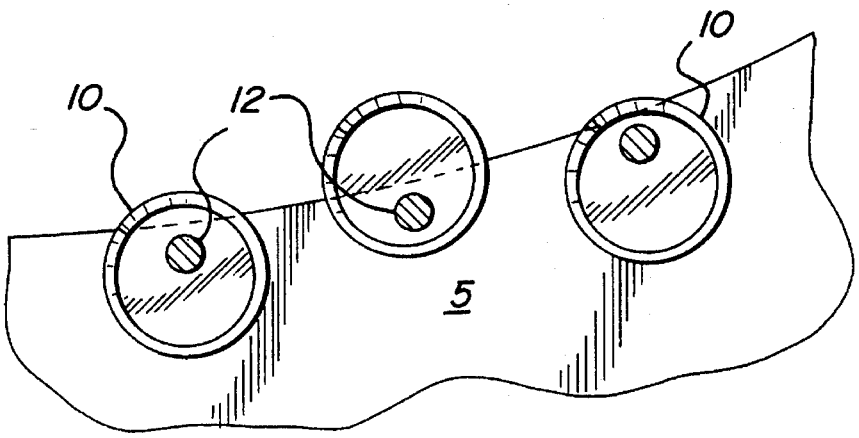

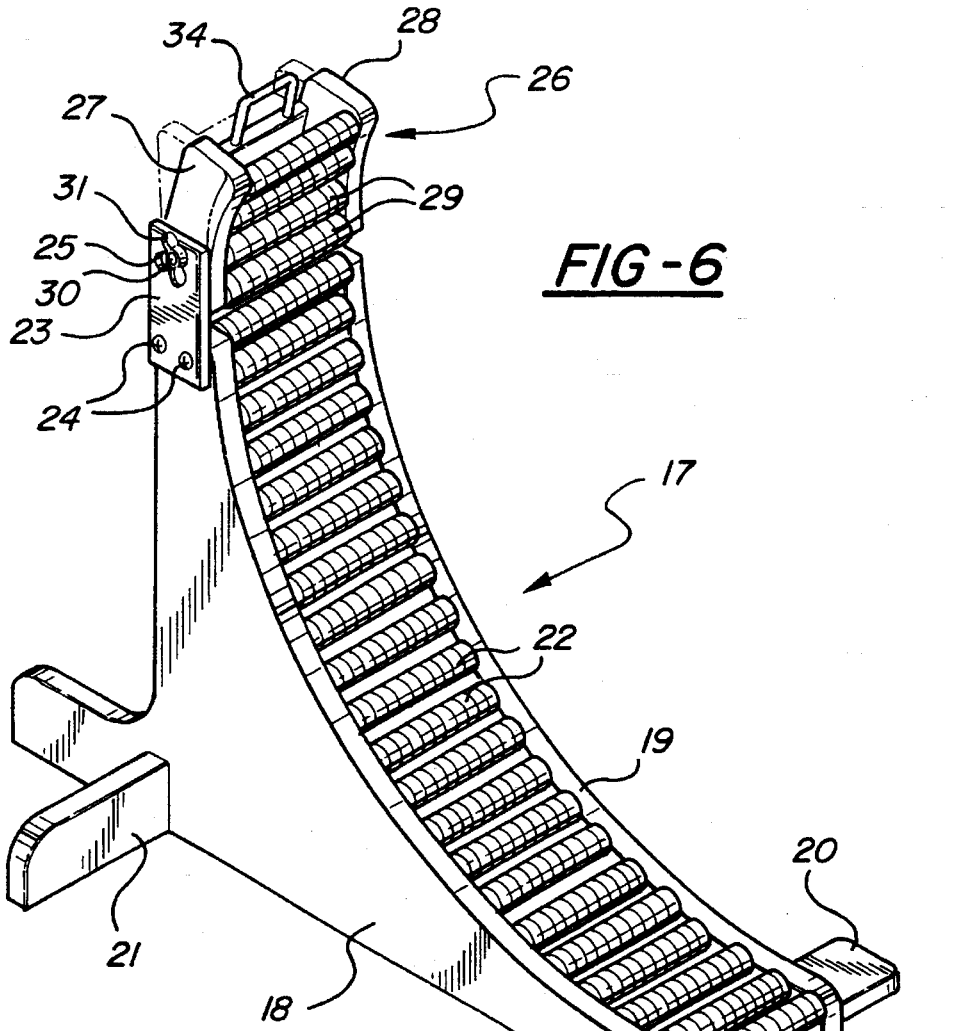
FIG-6
FIG-7
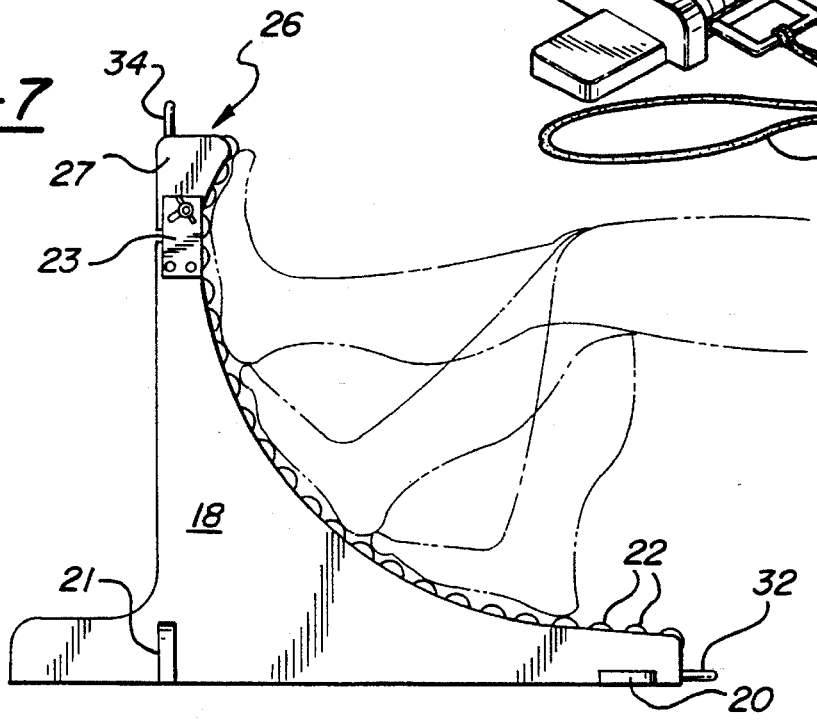

EXERCISE APPARATUS

This invention relates to exercise apparatus and more particularly to apparatus that is especially adapted for use in exercising a person's leg or legs while such person is in a sitting position.

BACKGROUND OF THE INVENTION

The knee and ankle joints of a person's leg and, to some extent, the person's hip, and the, muscles and tendons associated therewith require a certain amount of exercise, particularly in those instances in which the person is either too infirm to walk or has been injured in such manner as to make walking either undesirable or impractical. Nevertheless, exercise is necessary to maintain functionality of the ankle and knee joints, the muscles and tendons associated therewith, and to some extent the upper leg and hip while the person is seated.

SUMMARY OF THE INVENTION

Exercise apparatus constructed in accordance with the invention comprises a frame on which is journaled one or more banks of rollers arranged in parallel rows, there being sufficient rows of such rollers to extend from one end of the frame to the other. The rollers are so arranged as to present an arc and there are sufficient rows of rollers to enable a person's foot to be supported on such rollers while the leg is oscillated about the knee forwardly and rearwardly of the frame. The arc formed by the bank of rollers selectively is concave upwardly or convex upwardly and one end of the frame has an opening therein through which the toes of the person's foot may extend.

In one embodiment, the arc defined by the bank or banks of rollers is of uniform curvature. In another embodiment, however, an extension is mounted at one end of the frame for rocking movement about an axis and is provided with a plurality of rollers of its own. The extension may be rocked from a position in which its rollers constitute a continuation of the arc defined by the bank of rollers to another position in which the rollers carried by the extension form an arc having its center at a point different from the arc on which the bank of rollers is formed.

In each of the disclosed embodiments, provision is made for anchoring an elastic member at either of two ends of the frame so as to impose a yieldable resistance to movement of a person's leg in either or both of two opposite directions.

THE DRAWINGS

FIG. 3 is a view similar to FIG. 2, but illustrating the apparatus in an overturned position;

FIG. 4 is an end elevational view of one end of the apparatus;

FIG. 5 is an enlarged, fragmentary view illustrating adjacent rows of roller mounted on eccentric axes;

FIG. 6 is an isometric view of a modified embodiment; and

FIG. 7 is a side elevational view of the embodiment shown in FIG. 6 and illustrating its manner of use.

DETAILED DESCRIPTION

Figure 1:
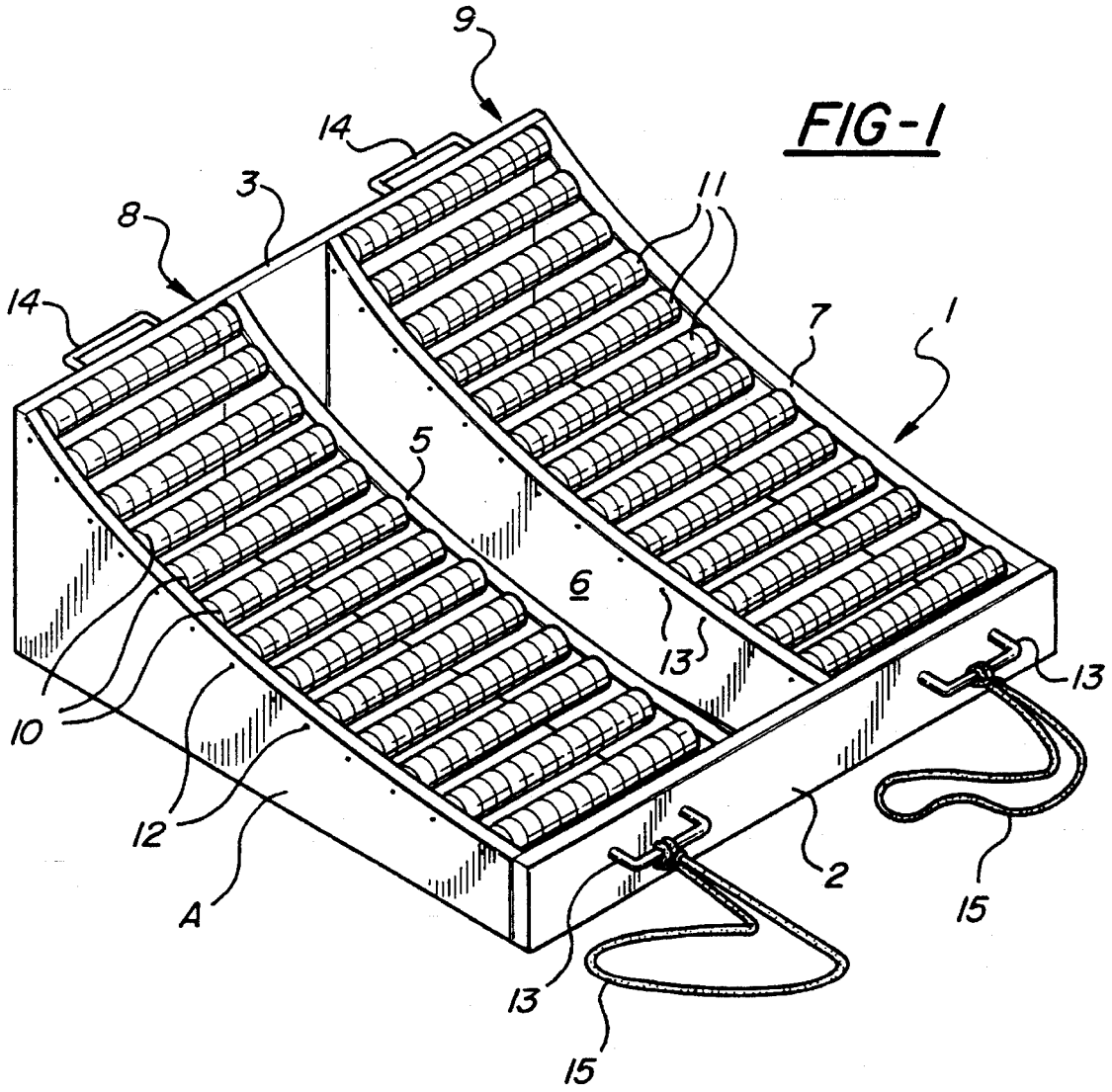
FIG. 1 is an isometric view of exercise apparatus constructed in accordance with one embodiment of the invention.
Figure 2:
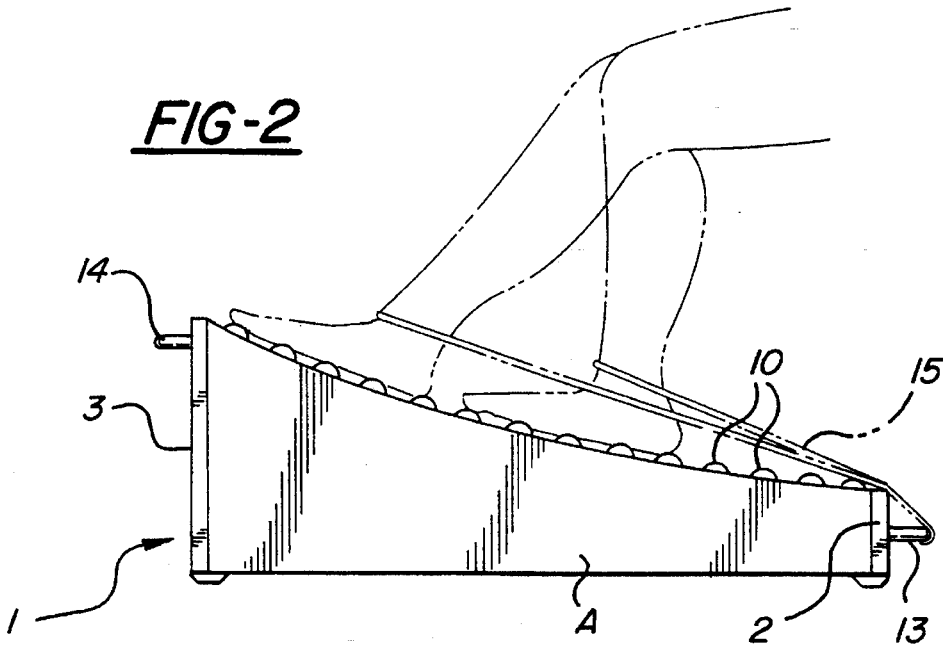
FIG. 2 is a side elevational view, on a reduced scale, of the apparatus shown in FIG. 1 and illustrating in phantom lines the manner of use of the apparatus.

Apparatus constructed in accordance with the embodiment shown in FIGS. 1–5 is indicated generally by the reference character 1 and comprises a frame composed of spaced apart, parallel end walls 2 and 3 joined to and spanning corresponding ends of side walls 4, 5, 6, and 7. The embodiment shown in FIG. 1 provides support for two banks 8 and 9 of rollers 10 and 11, each of which is journalled on a spindle 12 and 13, respectively, which are uniformly spaced apart and span the distance between the end walls 2 and 3 of the frame 1. The rollers of each row may be mounted about concentric axes, as is shown in FIGS. 1, 2 and 3, or the axes of adjacent spindles 12 may be eccentric, as is shown in FIG. 5. In either event, the rollers of each bank form an arc which may be either concave upwardly, as shown in FIGS. 1 and 2, or convex upwardly as is shown in FIG. 4, depending upon whether the frame 1 is in an upright position or an overturned position.

The end wall 2 is provided with an anchor member 13 in alignment with each bank of roller, and the opposite end wall 3 is provided with a pair of similar anchors 14. To each of the anchors may be tethered an elastic band 15 which is adapted to be coupled to a person's foot or leg, as is shown in FIG. 2. Similar bands 15 may be tethered to the anchor members 14 and similarly coupled to the person's foot or leg.

The end wall 3 of the frame 1 has a pair of openings 16 therein for a purpose presently to be explained.

The embodiment shown in FIG. 6 includes a frame 17 having spaced apart, parallel side walls 18 and 19 spanned by and joined together by cross members 20 and 21. The side walls 18 and 19 are spanned by spindles on which a bank of rollers 22 is journalled. The rollers extend from one end of the frame to the other and, together, form an upwardly concave arc. The cross members 20 and 21 extend beyond the respective side walls 18 and 19 so as to provide lateral support for the frame 17. The ends of the cross members 20 also enable a person's foot to bear upon the cross member so as to stabilize the frame.

At the upper end of the frame 17 is secured a pair of mounting plates 23 by means of screws 24 or other suitable fasteners. Each plate has an arcuate slot 25 adjacent its upper end.

Accommodated between the plates 23 is an extension 26 comprising a pair of spaced apart side members 27 and 28 spanned by a plurality of spaced apart spindles on which a bank of rollers 29 is journalled. Each side member 27, 28 carries a threaded shaft 30 which projects through the associated slot 25 and receives a rotatable wing nut 31. The construction and arrangement of the extension 26 are such that it is rockable relative to the frame members 18, 19 from the position shown in full lines in FIG. 6 to the position shown in chain lines. The wing nuts 31 may be manipulated to facilitate rocking movement of the extension 26 and securing it in a selected position of adjustment.

As is best shown in FIG. 7, the bank of rollers 29 form an arc and, preferably, the arc corresponds to that formed by the rollers 22. However, because the extension 26 is rockable, the center of the arc of the bank of rollers 29 may be varied.

At the lower end of the frame 17 an anchor member 32 is secured to the cross bar 20 for anchoring an elastic band 33.

A similar anchor member 34 is secured to the upper end of the extension 26 for anchoring a similar elastic band.

To prepare either embodiment of the invention for use, it is placed on a floor or other supporting surface forwardly of a chair in which a person is seated. In the embodiment shown in FIGS. 1–3, the person may place one foot on the left bank of rollers 10 and the other foot on the right bank of rollers 11. Preferably, the person's knees will be approximately midway between the end walls 2 and 3. The person then may oscillate his legs by flexing the knees and cause his feet to traverse the banks of rollers. The knees, therefore, constitute the radius of the arc of the bank of rollers. Because of the arcuate configuration of the rollers, the person's feet may remain in contact with the roller throughout the oscillation of the leg, thereby enabling exercise of the knees, ankles, toes, and associated muscles without requiring the person to change his position in the chair.

If desired, an elastic band 15 may be coupled to a selected one, or to each leg of the person, as is shown in FIG. 2, so as to provide yieldable resistance to oscillation of the leg in a direction toward the end wall 3. Alternatively, the elastic bands may be anchored to the members 14 carried by the end wall 3 and connected to the person's respective legs so as to oppose movement of the legs toward the end wall 2. It also is possible to connect elastic bands to the person's legs and to the anchors at opposite ends of the apparatus so as to provide resistance to movement of the person's legs in either direction.

In the use of the embodiment shown in FIGS. 6 and 7, the apparatus again is placed at the front of a chair or other support on which the person is seated so that his knee overlies the bank of rollers 22. In this embodiment, one of the person's feet may be placed on the cross member 20 to stabilize the frame during oscillation of the other leg.

In this embodiment, the extension 26 may be adjusted so that the bank of rollers supported by the extension forms a continuation of the arc of the bank of rollers 22, or it may be adjusted so that the center of the arc formed by the bank of rollers 29 is different from the center on which the arc of the rollers 22 is formed. Thus, if the extension 26 is rocked clockwise from the position shown in FIG. 7, the rollers 29 will form a surface which, when the person's foot encounters the rollers 29, will cause the ankle to be flexed so as to impose tension on the achilles tendon and the muscles at the rear of the person's leg.

An elastic band 33 may be secured to either or both of the anchor members 34 so as to provide yieldable resistance to oscillation of the person's leg.

In either of the disclosed embodiments, the rollers may be journalled on axes that are either concentric or eccentric. If the latter, oscillating movement of a person's foot along the supporting rollers will cause the latter to rotate about different axes and stimulate the person's foot.

If the apparatus 1 is overturned from the position shown in FIG. 2 to the position shown in FIG. 3, the arc formed by the rollers 10 and 11 is upwardly convex, rather than upwardly concave. When a person uses the apparatus in its overturned position, the leg will flex not only about the knee, but also about the hip joint. To enable the full surface formed by the bank of rollers to be traversed, the end wall 3 is provided with the openings 16 through which the person's toes may project.

Although the apparatus most likely will be used in such manner that the person's foot is oscillated forwardly and rearwardly, it also may be used in such manner that the person's foot may be oscillated from side to side. This operation may be facilitated if the chair in which the person is seated faces one side or the other of the roller-supporting frame so that the person's foot may engage the rollers as it is oscillated from side to side. This type of movement will exercise different muscles than those exercised by fore and aft oscillation.

The disclosed embodiments are representative of presently preferred forms of the invention, but are intended to be illustrative rather than definitive thereof. The invention is defined in the claims.

I claim:

1. Apparatus for use in exercising a person's foot and leg, said apparatus comprising a frame; at least one bank of rollers having a plurality of rows of rollers; means journalling the rollers of said bank of rollers on said frame, said rows being substantially parallel to one another and forming an arcuate support on which said person's foot may bear during oscillation of the person's leg; an elastic member; and anchor means carried by said frame for anchoring said elastic member to said frame in a position to be coupled to said person's leg and provide resistance to said oscillation in at least one direction.

2. Apparatus according to claim 1 wherein said arcuate support is upwardly concave.

3. Apparatus according to claim 1 wherein said arcuate support is upwardly convex.

4. Apparatus accordingly to claim 1 wherein selected ones of said rollers are journalled on eccentric axes.

5. Apparatus accordingly to claim 1 including a plurality of parallel banks of said rollers arranged side by side.

6. Apparatus according to claim 5 wherein there are two of said banks of rollers.

7. Apparatus accordingly to claim 1 wherein said frame has an opening therein in alignment with and at one end of said bank of rollers.

8. Exercise apparatus accordingly to claim 1 wherein said frame has an extension at one end thereof, a plurality of rows of additional rollers journalled on said extension and forming an extension of the arc defined by the rollers of said bank of rollers, and means for rocking said extension and the rollers journalled thereon in directions to vary the curvature of the extension of said arc.

9. Apparatus according to claim 8 including means for securing said extension in a selected position of adjustment relative to said frame.

10. Apparatus for use in exercising a person's foot and leg, said apparatus comprising a frame; a bank of parallel rows of rollers journalled on said frame, the rollers of said bank together defining an arcuate support on which said person's foot may bear during oscillation of the person's leg; an extension at one end of said frame; a plurality of rows of additional rollers journalled on said extension and forming an extension of the arc defined by the rollers of said bank of rollers; and means for rocking said extension and the rollers journalled thereon in directions to vary the curvature of the extension of said arc.

11. Apparatus according to claim 10 wherein said arcuate support is upwardly concave.

12. Apparatus according to claim 10 wherein said arcuate support is upwardly convex.

13. Apparatus according to claim 10 wherein selected ones of the rollers are journalled on eccentric axes.

14. Apparatus according to claim 10 including two adjacent banks of said rollers, each of said banks corresponding in configuration to the other.

15. Apparatus according to claim 10 including means for securing said extension in a selected position of adjustment relative to said frame.

16. Apparatus according to claim 10 including anchor means carried by said frame for anchoring said elastic member on said frame in a position to be coupled to said person's leg and provide resistance to said oscillation.

17. Apparatus according to claim 10 including anchor means carried by said extension for anchoring an elastic member adapted to be coupled for connection to said person's leg.

* * * * *